United States Patent [19]

Itoh et al.

[11] 4,285,694

[45] Aug. 25, 1981

[54] COLD PADDING BATCH DYEING PROCESS FOR TUBULAR KNITTED FABRICS

[75] Inventors: Shimpei Itoh, Suita; Masaru Daimon; Tadashi Kato, both of Itami, all of Japan

[73] Assignee: Nittobo Itamikako Co., Ltd., Itami, Japan

[21] Appl. No.: 105,441

[22] Filed: Dec. 19, 1979

[30] Foreign Application Priority Data

Dec. 26, 1978 [JP] Japan ..... 53-161532

[51] Int. Cl.[3] ..... D06P 3/82

[52] U.S. Cl. ..... 8/532; 8/151; 8/529; 8/549; 8/918

[58] Field of Search ..... 8/529, 532, 151, 549, 8/918

*Primary Examiner*—A. Lionel Clingman

*Attorney, Agent, or Firm*—Sughrue, Mion, Zinn, Macpeak and Seas

[57] ABSTRACT

A cold padding batch dyeing process for a tubular knitted fabric comprises feeding the fabric into a padding tank, subjecting it to air inflating, blowing compressed air into the fabric to expand it into its original tubular shape, squeezing the fabric at a squeezing rate of 95 to 120% by passing it between a pair of mangles each having a layer of rubber having a Shore hardness of 55 to 70, and leaving the fabric for ageing over a period of at least four hours. The length of time between entry of the fabric into the padding tank and its departure from the mangles is controlled to 10 to 20 seconds.

9 Claims, 1 Drawing Figure

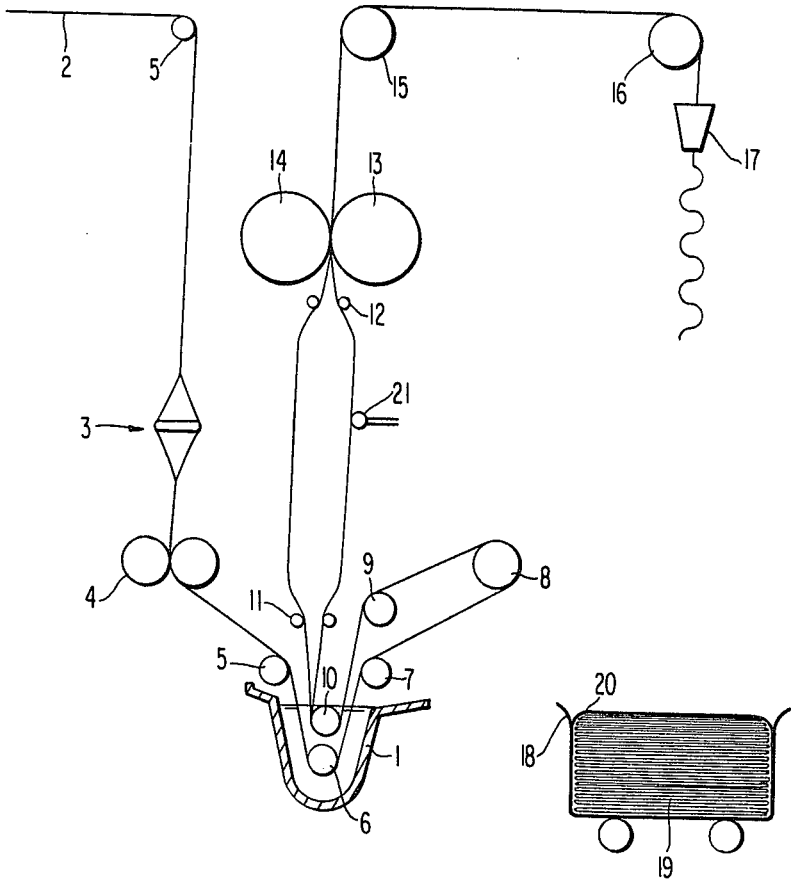
2
5
15
16
17
14
13
12
21
3
4
9
8
11
5
10
7
20
18
1
6
19

COLD PADDING BATCH DYEING PROCESS FOR TUBULAR KNITTED FABRICS

BACKGROUND OF THE INVENTION

1. Field of the Invention

This invention relates to a cold padding batch dyeing process for tubular knitted fabrics.

2. Description of the Prior Art

Dyeing of tubular knitted fabrics is usually conducted by a dip dyeing process in which a wince or jet dyeing machine is used. As this process is a batch process, however, its production efficiency is low, and it requires large quantities of auxiliary raw materials, water and fuel.

A cold padding batch dyeing process has, therefore, been developed and is known as an effective method in certain fields of application. In order to employ this process for dyeing a tubular knitted fabrics, however, it is necessary to cut and open the fabric into a shape similar to a woven cloth. Difficulty is involved in winding the fabric. The fabric is also difficult to handle as it must be kept in the open shape when passing through all the steps of soaping, softening and drying following the dyeing step. Thus, extensive and costly equipment is required for the dyeing of tubular knitted fabrics by the conventional cold padding batch process.

The cold padding batch dyeing process is known for a lot of advantages, including fine color reproducibility, highly efficient use of a dye, saving of dyeing auxiliaries, energy saving, low water consumption, and low equipment costs. Special care must, however, be taken for the preparation of the fabric to be dyed in order to accomplish uniform padding. The cold padding batch dyeing process is conducted at a padding temperature of about 20° C., and further involves a temperature as low as 10° C. to 30° C. for the ageing purpose. It does not include any dyeing step requiring a heat treatment, therefore, the success of dyeing depends on the uniformity of padding. The mere application of the process unavoidably results in the development of edge marks and unevenness of dyeing on the opposite sides of the fabric. In order to eliminate these inconveniences, it is necessary to ensure uniform penetration of a dye solution into the fabric to be dyed and maintenance of a homogeneous fabric structure.

If it is desired to keep a tubular knitted fabric in tubular shape for padding with a dyeing solution, the fabric is necessarily flattened into a two-ply shape, and the edge portions of the fabric are dyed to a higher density than the rest. After padding, the fabric cannot be squeezed satisfactorily by mangles of hard rubber used in the conventional cold padding batch process. Even if the squeezing pressure is regulated, thinner or thicker streaks are very likely to remain along the edges of the fabric.

It has, therefore, been proposed to use mangles formed from a softer rubber, and mangles of rubber having a Shore hardness of, 60, for example, have been found satisfactory for eliminating edge marks to thereby obtain a substantially uniformly dyed fabric. The mere use of such improved mangles is, however, not sufficient for complete removal of edge marks.

SUMMARY OF THE INVENTION

It is, therefore, an object of this invention to provide a cold padding batch dyeing process for tubular knitted fabrics, which enables dyeing of the fabric in tubular shape efficiently and uniformly without developing any edge mark or unevenness between the opposite sides of the fabric and without involving any extensive and complicated apparatus.

This invention is based on the discovery that the length of time from entry of the fabric into the padding tank to squeezing thereof has an important bearing on the development of edge marks and that if the aforementioned length of time is at least 10 seconds and preferably at least 15 seconds, the fabric hardly contains any edge marks. Treatment for any time less than 10 seconds results in appearance of edge marks, while any excess over 20 seconds does not only cause tailing, but also lowers productivity.

When the length of time from padding to squeezing is between 10 and 20 seconds, it has been found that by using mangles of rubber having a Shore hardness of 55 to 70 it is possible to accomplish uniform padding without having any edge marks. Any rubber having a Shore hardness over 70 develops edge marks in the fabric. Any rubber hardness below 55 (Shore) causes a higher degree of dye solution pick-up, leading to darkening of the edge portions of the fabric and formation of edge marks.

The tubular knitted fabrics which can be dyed in accordance with this invention include fabrics of cotton yarn or blended yarn containing cotton, union fabrics of those yarns and others, and those obtained by mercerizing such fabrics.

Suitable dyes which can be employed in the process of this invention include vinyl sulfone, dichloroquinoxaline and fluorochloropyrimidine type dyes. An appropriate amount of one or more alkalis is used to suit the dye used. The dye and the alkali should preferably be selected to ensure fixation of a substantial portion of the dye by ageing over a period of four to five hours in order to prevent uneven coloring by dripping of the dye solution during ageing, and avoid any adverse effect of water droplets and carbon dioxide.

BRIEF DESCRIPTION OF THE DRAWING

The drawing shows a schematic side elevational view of the apparatus employed for carrying out the process of this invention.

DETAILED DESCRIPTION OF THE INVENTION

A dye solution and an alkali solution are prepared separately, and mixed in an alkali mixer. The mixed solution is poured into a padding tank 1. A tubular knitted fabric 2 is fed into the padding tank 1 past guide rollers 5, a guide ring 3 and a pair of feed rollers 4. The fabric 2 is padded when passing around a guide roller 6 in the padding tank 1, and is subjected to airing when passing around guide rollers 7, 8 and 9. The fabric 2 is brought back into the padding tank 1 and moved past a guide roller 10 to be padded again. The fabric 2 is then delivered into a pair of mangles 13 and 14 through two pairs of guide rollers 11 and 12 disposed above the padding tank 1 in vertically spaced relationship, whereby the fabric 2 is squeezed.

An air nozzle 21 is provided between the two pairs of guide rollers 11 and 12, and is applied to the fabric 2 traveling therepast in flattened shape to blow compressed air into the flattened inner space of the fabric 2 through the tissues thereof to thereby expand the fabric 2 into its original tubular shape.

As already mentioned, the movement of the fabric 2 into the padding tank 1 and eventually out of the mangles 13 and 14 takes place within a period of 10 to 20 seconds and the mangles 13 and 14 have layers of rubber having a Shore hardness of 55 to 70. The mangles 13 and 14 are adapted to apply a squeezing pressure of 2 to 7 tons, usually 3 to 5 tons, to the fabric 2 to achieve a squeezing rate of 95 to 120%. The term squeezing rate as used herein is:

$$100\% \times \frac{\text{Weight of squeezed fabric} - \text{Weight of dry fabric}}{\text{Weight of dry fabric}}$$

Any squeezing pressure less than 2 tons fails to accomplish sufficient squeezing, resulting in the dripping of the dye solution of the fabric, while application of any pressure in excess of 7 tons is likely to develop moire, frosting, or other defects after squeezing in case the fabric is a single jersey knitted fabric.

The single jersey tubular knitted fabric permits squeezing at a high rate, but any squeezing rate over 120% is very likely to result in uneven dyeing, while moire is likely to develop if the squeezing rate is less than 100%. It is, therefore, desirable that this fabric should be squeezed at an optimum rate between 100% and 120% by mangles having layers of soft rubber having a Shore hardness of, say, 60.

An interlocked knit fabric permits squeezing at a high rate of, say, 120%, but as no moire is likely to develop on this fabric, it is better to apply a high squeezing pressure at a lower squeezing rate. Any squeezing rate below 95% is, however, undesirable since the edges of the fabric are likely to be somewhat too lightly colored.

A circular rib fabric, which has a clearly more uneven structure than an interlocked knit fabric, requires squeezing at a higher rate in order to achieve sufficient squeezing of the concave portions. It is, therefore, desirable to apply a higher pressure by using mangles having softer rubber and conduct squeezing at a rate of 95 to 105%. No squeezing rate higher than 120% should be adopted, because there is every possibility that dripping may occur during ageing with a resultant unevenness of coloring.

In any event, however, the squeezing rate adopted depends more or less on the viscosity, specific gravity and other factors of the mixed dye and alkali solution used.

This invention is characterized by preventing formation of edge marks by selecting appropriately the length of time involved between the padding and squeezing operations, and the hardness of the rubber used on the mangles, as described above. This invention is further featured by blowing compressed air into the flattened fabric immediately prior to its passage through the mangles to expand it into its original tubular shape. This feature ensures elimination of every possibility of edge mark formation according to the process of this invention.

The fabric 2 squeezed by passing between the mangles 13 and 14 is delivered past guide rollers 15 and 16, and plaited down through a plaiting unit 17 into a car 18 made of plastic. The fabric 19 falling into the car 18 is tightly packed therein so that the air trapped between the folds of the fabric is released to the maximum possible extent in order to prevent fading and uneven coloring which may otherwise be caused by neutralization of the alkali with carbon dioxide. Then, the fabric 19 is covered with a sheet 20 of polyethylene, vinyl or like material closing the car 18 and shutting off infiltration of air into the fabric 19, and is then left for the ageing treatment.

The fabric is left for ageing over a period of 4 to 5 hours if it is composed of a material capable of quick reaction, and for 15 to 16 hours in other cases. The ageing treatment should preferably be conducted at a constant temperature. The ageing temperature should be controlled within the range of 15° C. to 30° C.

After ageing, the fabric is washed with water, soaped, or otherwise treated in a customary manner.

The invention will now be described in further detail with reference to examples.

EXAMPLE 1

A tubular single jersey cotton knit fabric was dyed with a mixed dyeing solution of the following composition using the apparatus shown in the drawing. The dyeing solution contained 20 g of Remazol Black B, 3 g of Brilliant Red BB and 5 g of Brilliant Blue B per liter, and one to four proportions of sodium hydroxide (caustic soda) and sodium silicate. The solution was prepared with an alkali mixer and had a pH of 12.2. The length of time between the entry of the fabric into the padding tank and its departure from the mangles was 15 seconds. The mangles each had a layer of rubber having a Shore hardness of 58. A squeezing pressure of 4.5 tons was applied to the fabric passing between the mangles. The squeezing rate was 105%.

After squeezing, the tubular knitted fabric was plaited down into the car through the plaiting unit, and folded over itself so tightly as to minimize air trapped therein. Then, a sheet of polyethylene was placed on the top of the fabric in intimate contact therewith to enclose it and seal it from the air, and the fabric was left for ageing over a period of 16 to 24 hours, followed by soaping and other customary after-treatments.

The product thus obtained was a navy blue dyed fabric having no moire, unevenly colored spot or edge mark, nor any difference in color tone between the opposite sides thereof.

COMPARATIVE EXAMPLE 1

The dyeing operation described in Example 1 was repeated, except that the length of time which was 15 seconds was changed to 3 seconds, and that each mangle had a layer of rubber having a Shore hardness of 80, instead of 58. There was obtained a dyed fabric having heavy edge marks and moires.

EXAMPLE 2

A tubular interlocked cotton knit fabric was dyed with a mixed dyeing solution of the following composition by using the apparatus shown in the drawing. The dyeing solution contained 0.6 g of Levafix Brown B2R, 0.12 g of Blue EB and 0.36 g of Yellow E3RL per liter, and 20 to 1 (by weight) proportions of soda ash and sodium hydroxide. The solution was prepared by an alkali mixer, and had a pH of 11.4. The length of time between padding and squeezing, which was 15 seconds in Example 1, was 10 seconds in this example. The mangles each had a layer of rubber having a Shore hardness of 65, and applied a squeezing pressure of 3 tons to the fabric. The fabric thus squeezed showed a squeezing rate of 98%.

The fabric was, then, plaited down into the ageing car through the plaiting unit, and folded over itself tightly to minimize trapping of air therein. Then, a sheet of vinyl was placed on the top of the fabric in intimate contact therewith to enclose it, and the fabric was left for ageing over a period of 6 to 18 hours, followed by soaping and other customary after-treatments.

There was, thus, obtained a dyed fabric of beige color having no such defect as dye bleeding, edge marks and difference in color tone between the opposite sides of the fabric.

While the invention has been described with reference to preferred examples thereof, it is to be understood that further variations or modifications may be easily made therein by persons of ordinary skill in the art without departing from the spirit and scope of this invention as defined by the appended claims.

What is claimed is:

1. A cold padding batch dyeing process for a tubular knitted fabric of cotton or a cotton blend, comprising:

feeding said tubular knitted fabric into a padding tank;

inflating said fabric with air by forcing air into said fabric to expand it into a tubular shape;

squeezing said fabric at a squeezing rate of 95 to 120% by passing it between a pair of mangles each having a layer of rubber having a Shore hardness of 55 to 70; and ageing said fabric for at least a period over four hours;

the length of time between entry of said fabric into said padding tank and its departure from said mangles being limited to between 10 and 20 seconds.

2. The process of claim 1, wherein said squeezing rate is obtained by applying a pressure of 2 to 7 tons to said fabric.

3. The process of claim 2, wherein said length of time between entry and departure is at least 15 seconds.

4. The process of claim 3, wherein said period of ageing does not exceed 16 hours.

5. The process of claim 4, wherein ageing is conducted at a constant temperature between 15° C. and 30° C.

6. The process of claim 1, wherein said fabric is a fabric selected from the group consisting of a cotton yarn fabric, a blended yarn fabric containing cotton, a union fabric of said cotton or blended yarn and another yarn, and a fabric obtained by mercerizing any of said fabrics.

7. The process of claim 1, wherein said padding tank holds a mixed dye and alkali solution containing a dye selected from the group consisting of vinyl sulfone, dichloroquinoxaline and fluorochloropyrimidine dyes.

8. The process of claim 7, wherein said solution contains at least one alkali selected from the group consisting of sodium hydroxide, sodium silicate and soda ash.

9. The process of claim 1, wherein said rubber has a Shore hardness of 60.

* * * * *